United States Patent [19]

Yamachika et al.

[11] 4,026,384

[45] May 31, 1977

[54] RECONSTITUTED MICA ACOUSTIC DIAPHRAGM

[75] Inventors: Kenzabro Yamachika, Nakama; Ituro Sonoda; Ichimatsu Kishimoto, both of Kitakyushu; Masaaki Matsushima, Nakama, all of Japan

[73] Assignee: Okabe Mica Co., Ltd., Japan

[22] Filed: Nov. 24, 1975

[21] Appl. No.: 634,736

[30] Foreign Application Priority Data

Dec. 17, 1974 Japan ..... 49-144108

[52] U.S. Cl. ..... 181/167

[51] Int. Cl.² ..... G10K 13/00; H04R 7/00

[58] Field of Search ..... 181/167, 169, 170; 264/110; 106/286

[56] References Cited

UNITED STATES PATENTS

| | | | |
|---|---|---|---|
| 1,192,833 | 7/1916 | Steurer | 181/170 |
| 2,760,879 | 8/1956 | McDaniel, Jr. et al. | 264/110 |
| 3,226,286 | 12/1965 | Scheuer | 264/110 |
| 3,880,972 | 4/1975 | Towne et al. | 264/110 |
| 3,930,130 | 12/1975 | Boszor | 181/169 |

*Primary Examiner*—Stephen J. Tomsky
*Attorney, Agent, or Firm*—Wenderoth, Lind & Ponack

[57] ABSTRACT

An acoustic diaphragm composed essentially of a flat, cone-like or dome-like reconstituted mica paper of fine scaly mica flakes and an organic polymeric binder impregnated in the mica paper. The diaphragm has a density of 1.3 to 2.3 g/cm³ and a Young's modulus of 6 × 10¹⁰ to 3 × 10¹² dyne/cm².

4 Claims, 3 Drawing Figures

RECONSTITUTED MICA ACOUSTIC DIAPHRAGM

BACKGROUND OF THE INVENTION

This invention relates to an acoustic diaphragm made of a mica sheet and having an improved Young's modulus.

Diaphragms for acoustic devices such as the cone of a loudspeaker have previously been made of pulp paper. Since conventional acoustic diaphragms of this kind have a low Young's modulus and their first resonance frequency point does not reside in a sufficiently high frequency range, they suffer from the defect of causing low-fidelity reproduction of sounds. Furthermore, because of their low moisture resistance, their Young's modulus changes by moisture absorption.

SUMMARY OF THE INVENTION

Accordingly, it is an object of this invention to provide a high-fidelity acoustic diaphragm having a high Young's modulus and a first resonance frequency point in a high frequency range.

Another object of this invention is to provide an acoustic diaphragm having superior moisture resistance and stable physical properties not affected by the degree of atmospheric moisture.

The above objects can be achieved in accordance with this invention by an acoustic diaphragm made of a mica sheet having a flat or curved surface and composed essentially of a number of scaly flakes with a size of 8 to 400 mesh of a mica selected from the group consisting of natural mica, synthetic mica and partially dehydrated natural mica and an organic polymeric binder, said scaly mica flakes having their cleavage planes (001 plane) oriented parallel to the flat or curved surface of said mica sheet and being bonded to one another through said binder at their cleavage planes (001 plane), and said mica sheet having a density of 1.3 to 2.3 g/cm$^3$ and a Young's modulus of $6 \times 10^{10}$ dyne/cm$^2$ to $3 \times 10^{12}$ dyne/cm$^2$.

The natural mica used in this invention is a naturally occurring mineral of the mica group. The synthetic mica is a synthetic mineral having the composition $KMg_3(AlSi_3O_{10})F_2$ or $KAl_2(AlSi_3O_{10})F_2$. The partially dehydrated natural mica is obtained by heating the natural mica so as to remove 10 to 90% by weight of its water of crystallization. In the present application, the above-mentioned natural mica, synthetic mica and partially dehydrated mica are generically termed mica.

The acoustic diaphragm of this invention can be conveniently produced by a process comprising a series of a delaminating step, a sieving step, a mica paper-forming step, an impregnating step and a hot-press step. These steps are described in detail below.

DELAMINATING STEP

This step involves the delamination of a starting mica mass into fine scaly flakes by application of a water jet. The mica mass is cleaved along its cleavage plane by the action of water jet. The cleaved mica flakes are split perpendicularly to the cleavage plane. The fine scaly flakes can be obtained by repeating the cleavage and splitting. In a typical example, a predetermined amount of the starting mica mass is let fall into a delaminator from a hopper, and a water jet is impinged against the micaceous mass, whereby the micaceous mass is cleaved and split perpendicularly to its 001 plane. Gradually, the mass is converted into fine scaly mica flakes, and dispersed in water. The water dispersion is passed through a strainer plate having pores, and the mica flakes are withdrawn from the delaminator.

The water jet is impinged at a speed of 50 to 150 meters/second, preferably 80 to 120 meters/second, and the amount of water used is 10 to 50 times the weight of the micaceous mass. The size of the mica flakes obtained by this step is generally in the range of 8 to 400 mesh.

SIEVING STEP

This step comprises collecting a suspension of mica flakes of the desired size from the water dispersion of the fine scaly mica flakes obtained by the delaminating step.

Sieving can be advantageously carried out using a fractional centrifugal separator or a settling tank. Other sieving devices can also be used, if desired.

The mica flakes to be collected by this sieving step have a size of 8 to 400 mesh, preferably 32 to 200 mesh, and the collected suspension contains the mica flakes in an amount of about 0.3 to 5.0% by weight, preferably 0.6 to 1.0% by weight.

MICA PAPER-FORMING STEP

This step comprises integrating the mica flakes in the suspension collected in the sieving step into a reconstituted mica paper (referred to simply as mica paper) of a desired shape such as a flat, cone-like or dome-like mica paper.

The flat mica paper can be conveniently produced by using a paper machine. A suspension of the mica flakes with a mica concentration of 0.3 to 5% is fed into the paper machine at a rate of 50 to 500 Kg/minute, and under these conditions, a flat mica paper having the desired thickness can be formed continuously at a mica paper-forming speed of 1 to 10 meters/minute.

The cone-like or dome-like mica paper can be produced by pouring the suspension of the mica flakes onto a cone-like or dome-like wire gauze to accumulate the mica flakes to a predetermined thickness, and dehydrating and drying them.

This step makes it possible to produce a mica paper of a desired shape such as a flat, cone-like or dome-like shape which has a thickness of about 0.02 to 1.0 mm. In the mica paper, the mica flakes are bonded to one another partly by a van der Waals force while the cleavage planes of the individual mica flakes are oriented parallel to the sheet surface. Therefore, if it is handled with good care, it can retain its reconstituted mica paper form.

IMPREGNATING STEP

This step comprises impregnating the binder in the mica paper obtained by the mica paper-forming step.

Example of suitable binders are organic polymeric binders such as phenol-formaldehyde resin, a ureaformaldehyde resin, a polymethyl methacrylate resin, a polyacrylate ester resin, an epoxy resin, a silicone resin, a silicone rubber, an acrylonitrile-butadiene-styrene copolymer rubber, a styrene-butadiene copolymer rubber, an unsaturated polyester resin or a polyurethane resin. Preferably, the binder is used as a solvent solution or emulsion.

A typical example of a method for impregnating the mica paper with the binder comprises spraying a solution of the binder onto the mica paper. The impregnation can also be performed by coating a solution of the binder on the mica paper. The amount of the binder is 5 to 50% by weight, preferably 10 to 30% by weight, as the solids content of the binder solution. When the impregnation is carried out by spraying, the amount of the binder to be impregnated can be controlled by adjusting the concentration of the binder solution and the amount of the solution sprayed.

HOT-PRESS STEP

This step makes it possible to cure the binder resin or solidify it by hot melt and pressing and thus to impart strength to the final product.

If desired, the impregnated mica paper is pretreated at a temperature of 80° to 120° C. for 5 to 20 minutes so as to remove the solvent or pre-cure the binder prior to the hot-press step.

The hot press can be performed by placing the binder-impregnated mica paper of such a shape as a cone or dome in a metal die, and heating it under pressure.

When the mica paper is flat, it can be molded easily by an ordinary press having upper and lower heated plates.

The temperature, pressure and time employed for the hot press step differ according to the type and content of the binder used. For example, when an epoxy resin is used as the binder, the pressing temperature is 150° to 200° C., the pressing time is 10 to 40 minutes, and the pressing pressure is 10 to 100 Kg/cm$^2$.

The binder-bonded mica paper so obtained is referred to in this application as a mica sheet.

The mica sheet consists of 50 to 95% by weight, preferably 70 to 90% by weight, based on the total weight of the mica sheet, of fine scaly mica flakes having a size of 8 to 400 mesh, preferably 32 to 200 mesh, and 5 to 50 % by weight, preferably 10 to 30% by weight, based on the total weight of the mica sheet, of the binder, and have a flat plane or a curved plane of a cone-like or dome-like shape and a thickness of about 0.02 to 1.0 mm, preferably 0.05 to 0.50 mm. The fine scaly mica flakes in the mica sheet are bonded to one another by the binder with their cleavage planes being oriented parallel to the mica sheet surface. The mica sheet has a density of 1.3 to 2.3 g/cm$^3$, preferably 1.4 to 2.0 g/cm$^3$, and a Young's modulus of $6 \times 10^{10}$ to $3 \times 10^{12}$ dyne/cm$^2$, preferably $1.0 \times 10^{11}$ to $1.0 \times 10^{12}$ dyne/cm$^2$.

The mica sheet can be directly used as an acoustic diaphragm. For example, the cone-shaped mica sheet of a predetermined size can be incorporated as a cone diaphragm in a loudspeaker.

DESCRIPTION OF THE DRAWINGS

In FIG. 3, curve 1 is a characteristic curve of the diaphragm of the present invention, and curve 2 is that of a comparison diaphragm made of pulp paper .

Figure 3:
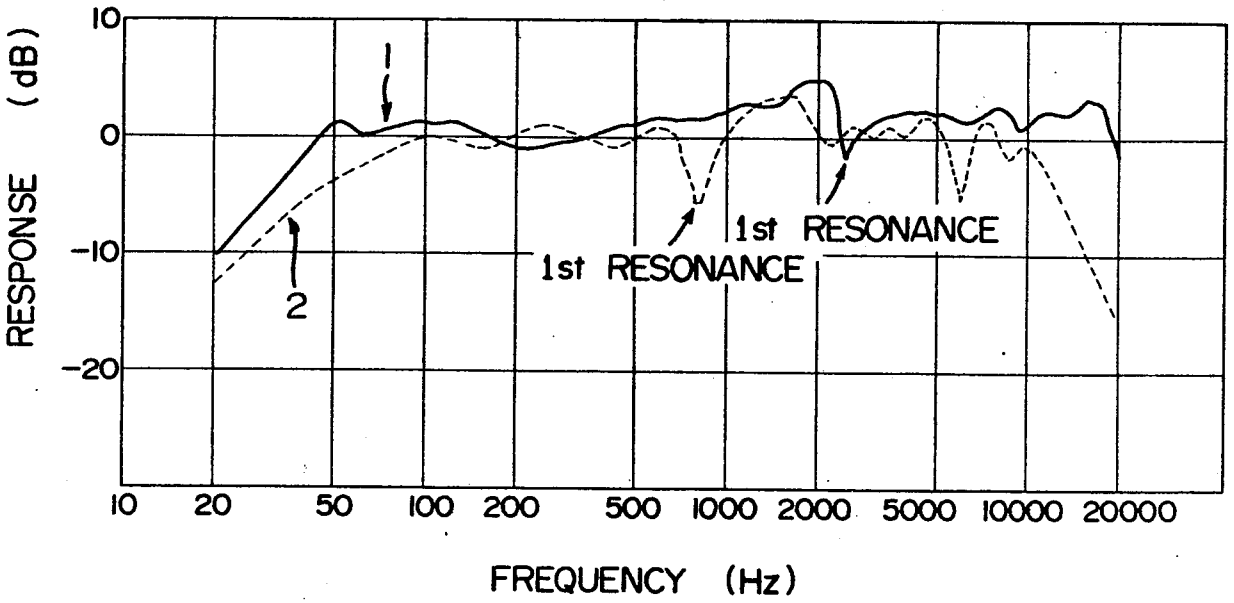
FIG. 3 is a graphic representation showing frequency-response characteristics of full range loudspeakers having incorporated therein the acoustic diaphragm of this invention and a comparison acoustic diaphragm.

It will be seen from FIG. 3 that the diaphragm of this invention has a first resonance frequency point on the high frequency side as compared with the conventional diaphragm made of pulp paper.

The diaphragm of this invention has a resonance frequency point in a high frequency range of, say, 2.5 to 3.0 K Hz, and therefore, can give reproduced sounds of high fidelity.

The diaphragm of this invention has a superior moisture resistance. Thus, even when it is allowed to stand for prolonged periods of time in a high humidity atmosphere, the amount of moisture it absorbs does not appreciably increase. For example, when it was allowed to stand for 15 days in an environment kept at a temperature of 20° C. and a relative humidity of 96%, the amount of moisture it absorbed during this time was only less than 1.0%, and even less than 0.5%, and no appreciable change was observed in its Young's modulus. The mica diaphragm of this invention, therefore, does not undergo deterioration in its performance even when used outdoors or during rainfall.

The following Examples further illustrate the present invention.

Unless otherwise specified, all parts and percentages are by weight. The physical properties shown in the examples were determined by the following test methods.

YOUNG'S MODULUS

Calculated from the following equation in accordance with a method for testing a Young's modulus (resonance method) set forth in Appendix 3 to JIS C-2530.

$$E = 38.32 \times \frac{f^2 \cdot l^4}{t^2} \rho$$

wherein

E is the Young's modulus (dyne/cm$^2$);

$f$ is the first resonance frequency (Hz);

$l$ is the distance (cm) between indicator points of a test specimen;

$\rho$ is the density (g/cm$^3$) of the test specimen; and $t$ is the thickness (cm) of the test specimen.

MOISTURE ABSORPTION

Measured in accordance with JIS C-2111, 8.

DENSITY

Measured in accordance with JIS C-2111, 6.1.

EXAMPLE 1 a. Block mica coarsely pulverized to a size of about 10 × 15 × 15 mm was delaminated into fine flakes by impinging a water jet under a pressure of about 80 Kg/cm$^2$ against it while feeding it constantly at a rate of about 5 Kg/minute. It was passed through a strainer, withdrawn from it, and sent to a settling tank, where flakes having a size of 32 to 200 were collected.

Water was added to form a suspension of mica flakes with a mica concentration of 5% and the suspension was let fall onto a cone-shaped 60-mesh screen with an outside diameter at its periphery of 20 cm to deposit the mica flakes in a thin layer on the screen. They were heated to a temperature of 110° C. to dry them. The resulting mica paper could be easily removed from the screen. Thus, there was obtained a cone-shaped mica paper having an outside diameter at its periphery of 16 cm and a weight of about 8 g.

b. 40 G of a mixed solution consisting of 100 parts of Epikote 828 (trademark for an epoxy resin, a product of Shell Chemical Co.) diluted to a concentration of 5% with a 1:1 mixture of xylene and methyl ethyl ketone, 3 parts of boron fluoride monethylamine and 27 parts of diaminodiphenyl sulfone was sprayed by a sprayer onto the cone-shaped mica paper obtained in (a) above thereby to impregnate about 20% by weight (based on the total amount of the binder and the mica paper) of the binder.

Figure 1:
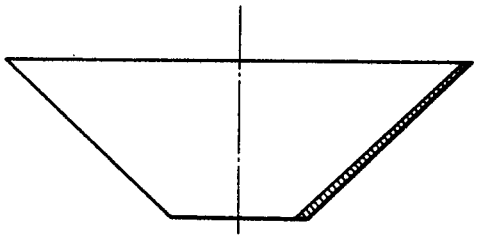
FIG. 1 is a cross-sectional view of a cone-shaped loudspeaker diaphragm according to the present invention.

After this impregnating treatment, the impregnated mica paper was dried at 110° C. for 15 minutes, pre-cured, and hot-pressed at a temperature of 160° C. and a pressure of 50 Kg/cm$^2$ for 40 minutes using a cone-shaped metal die. Then, the resulting mica sheet was post-cured in an oven at 140° C. for 6 hours to make an epoxy resin-bonded cone-shaped mica diaphragm having a thickness of about 0.25 mm as illustrated in FIG. 1 of the drawings.

A test specimen (0.18 × 20 × 60 mm) prepared under the same conditions as in the above-described production of the cone-shaped mica diaphragm was examined for its Young's modulus and density. It was found to have a Young's modulus of 7.2 × 10$^{11}$ dyne/cm$^2$ and a density of 1.95 g/cm$^3$.

c. The above cone-shaped mica diaphragm and a diaphragm made of pulp paper and having the same size and shape were each placed in an atmosphere held at a relative humidity of 96% and a temperature of 20° C., and changes in their Young's modulus and moisture absorption were determined. The results are shown in Table 1.

Table 1

| Number of days allowed for moisture absorption | | 5 days | 10 days | 15 days |
|---|---|---|---|---|
| Mica diaphragm | Amount of moisture absorption (%) | 0.05 | 0.08 | 0.10 |
| | Young's modulus (dyne/cm$^2$) | 2.7 × 10$^{11}$ | 3.0 × 10$^{11}$ | 2.5 × 10$^{11}$ |
| Pulp diaphragm | Amount of moisture absorption (%) | 4.8 | 10.7 | 12.2 |
| | Young's modulus (dyne/cm$^2$) | 2.0 × 10$^{10}$ | 9.5 × 10$^9$ | 8.4 × 10$^9$ |

It can be seen from the data given in Table 1 that in the mica diaphragm of this invention, the rate of an increase in moisture absorption is small, and the fluctuations of the Young's modulus are also little.

On the other hand, the pulp diaphragm, upon exposure to a high-humidity atmosphere for long periods of time, absorbs moisture in an increased amount and has a reduced Young's modulus since it has poor moisture-proofness.

d. The same mica diaphragm and pulp paper diaphragm as used in (c) above were incorporated in full range loudspeakers, and tested for their frequency-response characteristics. The characteristic curves are shown in the accompanying drawing, in which curve 1 is a characteristic curve of the mica diaphragm and curve 2 is a characteristic curve of the pulp paper diaphragm.

As is seen from the characteristic curves, the loudspeaker having incorporated therein the diaphragm of this invention has a first resonance frequency shifted toward a higher frequency range than the loudspeaker having incorporated therein the pulp diaphragm. Accordingly, it can permit the freedom from partial vibration over a wide range, and thus can generate reproduced sounds of high fidelity.

EXAMPLE 2

Figure 2:
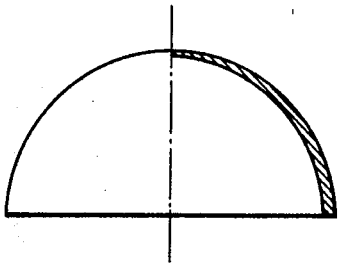
FIG. 2 is a cross-sectional view of a dome-shaped loudspeaker diaphragm according to the present invention.

A dome-shaped mica paper was prepared in the same way as in Example 1 except that a dome-shaped screen having an outside diameter at its periphery of 75 mm was used instead of the cone-shaped screen used in (a) of Example 1. The resulting dome-shaped mica paper had an outside diameter at its periphery of 75 mm and a weight of 1.4 g. 3.5 g of a polymethyl methacrylate solution diluted to a concentration of 10% with a 1:1 mixture of toluene and methyl ethyl ketone was sprayed onto the resulting dome-shaped mica paper in the same way as in Example 1, to impregnate 20% by weight of the binder in the mica paper. After impregnation, the impregnated mica paper was dried at 100° C. for 10 minutes, and hot-pressed at 150° C. and 80 Kg/cm$^2$ for 10 minutes using a dome-shaped metal die. Then, the hot-pressed mica sheet was post-cured in an oven at 140° C. for 4 hours to form a polymethyl methacrylate-bonded dome-shaped mica diaphragm having a thickness of 0.1 mm as illustrated in FIG. 2 of the drawings.

A test specimen (0.18 × 20 × 60 mm) prepared in the same way as in the preparation of the dome-shaped mica diaphragm described above was found to have a Young's modulus of 2.63 × 10$^{11}$ dyne/cm$^2$ and a density of 1.60 g/cm$^3$.

EXAMPLE 3

20 g of a solution obtained by adding 0.3 part of bis-2,4-dichlorobenzoyl peroxide to 100 parts of a 10% xylene solution of YE 3106 U (trademark for a silicone rubber, a product of toshiba Silicone Co., Ltd.) was sprayed onto the same cone-shaped mica paper as obtained in (a) of Example 1 in the same way as in Example 1 to impregnate the silicone rubber binder in an amount of about 20% by weight.

After impregnation, the impregnated mica paper was dried at 100° C. for 30 minutes to pre-cure it, and then hot-pressed at 130° C. and 50 Kg/cm$^2$ for 15 minutes using a cone-shaped metal die. The resulting mica sheet was post-cured in an oven at 150° C. for 6 hours to make a silicone rubber-bonded cone-shaped mica diaphragm having a thickness of 0.2 mm.

A test specimen (0.18 × 20 × 60 mm) prepared in the same way as in the preparation of the diaphragm described above was found to have a density of 1.68 g/cm$^3$ and a Young's modulus of 1.96 dyne/cm$^2$.

EXAMPLE 4

A 30% solution of Sumilack PC-1 (trademark for a phenol resin-type binder, a product of Sumitomo Bakelite Co., Ltd.) in a 1:1 mixed solvent of methanol and toluene was sprayed onto the cone-shaped mica paper obtained in Example 1 to impregnate the binder in an amount of about 20%. The impregnated mica paper was allowed to stand for 3 hours at room temperature, and hot-pressed by a cone-shaped metal die at 130° C. and 100 Kg/cm$^2$ for 15 minutes. After withdrawal from the die, the resulting mica sheet was post-cured in an oven at 150° C. for 6 hours to make a phenol resin-bonded cone-shaped mica diaphragm having a thickness of 0.2 mm.

A test specimen (0.18 × 20 × 60 mm) prepared in the same way as in the preparation of the diaphragm described above was found to have a density of 1.73 g/cm³ and a Young's modulus of $5.3 \times 10^{11}$ dyne/cm².

EXAMPLE 5

One part of Catalyzer CR-25 (trademark for a product of Toshiba Silicone Co., Ltd.) was added to 100 parts of a 60% xylene solution of TSR-125 (trademark for a silicone resin-type binder a product of Toshiba Silicone Co.,Ltd.), and the concentration of the solvent was adjusted to about 10% with a 1:1 mixed solvent of methanol and toluene. The resulting solution was sprayed onto the same dome-shaped mica paper as prepared in Example 2 to impregnate it to a binder content of about 8%. The impegnated mica paper was then dried at 110° C. for 5 minutes to pre-cure it, and hot-pressed at 160° C. and 140 Kg/cm² for 40 minutes using a dome-shaped metal die. After withdrawal from the die, the resulting mica sheet was post-cured stepwise in an oven at 100° C. for 30 minutes, at 150° C. for 30 minutes, at 200° C. for 30 minutes, at 300° C. for 30 minutes, and finally at 350° C. for 1 hour to make a silicone resin-bonded dome-shaped mica diaphragm having a thickness of 0.1 mm.

A test specimen (0.18 × 20 × 60 mm) prepared in the same way as in the preparation of the diaphragm described above was found to have a density of 1.87 g/cm³ and a Young's modulus of $6.3 \times 10^{11}$ dyne/cm².

EXAMPLE 6

One part of benzoyl peroxide was added to 100 parts of a 60% styrene solution of PS-309 (trademark for an unsaturated polyester resin-type binder, a product of Hitachi Chemical Co., Ltd.). The resulting solution was sprayed on the same cone-shaped mica paper as obtained in (a) of Example 1 to impregnate it to a binder content of about 15%. After allowing the impregnated mica paper to stand at room temperature, it was hot-pressed at 160° C. and 100 Kg/cm² for 10 minutes using a cone-shaped metal die. After withdrawal from the die, the resulting mica sheet was post-cured in an oven at 150° C. for 6 hours to make an unsaturated polyester resin-bonded cone-shaped mica diaphragm having a thickness of 0.2 mm.

A test specimen (0.18 × 20 × 60 mm) prepared in the same way as in the preparation of the diaphragm described above was found to have a density of 1.86 g/cm³ and a Young's modulus of $6.8 \times 10^{11}$ dyne/cm².

EXAMPLE 7

The same cone-shaped mica paper as obtained in (a) of Example 1 was impregnated with each of the various binders indiated in Table 2 and hot pressed in the same way as in Example 1 to form diaphragms. The properties of these diaphragms are shown in Table 2.

For comparison, the properties of a pulp paper diaphragm are shown together.

Table 2

| | Impregnated resin binder | Binder content (%) | Thickness (mm) | Density ($\rho$) (g/cm³) | Young's modulus (E) (dyne/cm²) | E/$\rho$ |
|---|---|---|---|---|---|---|
| Mica diaphragm | Epikote 1031, $BF_3$-400 | 15 | 0.10 | 1.76 | $7.05 \times 10^{11}$ | $3.5 \times 10^{11}$ |
| | Epikote 1009, $BF_3$-400 | 15 | 0.10 | 1.90 | $7.74 \times 10^{11}$ | $4.0 \times 10^{11}$ |
| | Epikote 1004, $BF_3$-400 | 15 | 0.13 | 1.46 | $4.44 \times 10^{11}$ | $3.0 \times 10^{11}$ |
| | Epikote 871, $BF_3$-400, DDS | 15 | 0.15 | 1.51 | $4.03 \times 10^{11}$ | $2.7 \times 10^{11}$ |
| | Epikote 828, $BF_3$-400 | 15 | 0.10 | 1.85 | $6.53 \times 10^{11}$ | $3.5 \times 10^{11}$ |
| | Polyester-toluene diisocyanate (a product of Nippon polyurethane Industry Co.) | 15 | 0.10 | 1.83 | $4.17 \times 10^{11}$ | $2.3 \times 10^{11}$ |
| | ABS | 15 | 0.11 | 1.72 | $3.31 \times 10^{11}$ | $1.9 \times 10^{11}$ |
| | SBR | 15 | 0.14 | 1.49 | $4.24 \times 10^{11}$ | $2.8 \times 10^{11}$ |
| | YE 3106 U, CE-50 | 15 | 0.13 | 1.68 | $1.96 \times 10^{11}$ | $1.2 \times 10^{11}$ |
| Pulp diaphragm | — | — | 0.44 | 0.42 | $1.87 \times 10^{10}$ | $4.5 \times 10^{10}$ |

It can be seen from Table 2 that the mica diaphragms in accordance with this invention have a Young's modulus (E) about ten times as large as that of the pulp diaphragm, and its E/$\rho$ ratio is also about ten times as high as that of the pulp diaphragm.

The binders indicated by trademarks in Table 2 are explained as follows:

1. Epikote 1031, 1009, 1004, 871 and 828 are epoxy resins manufactured by Shell Chemical Co., and $BF_3$-400 and DDS are curing agents for epoxy resins manufactured by Shell Chemical Co.

2. YE 3106 U is a silicone rubber manufactured by Toshiba Silicone Co., Ltd., and CE-50 is a cross-linking agent made by the same company.

3. ABS is an acrylonitrile-butadiene-styrene copolymer rubber manufactured by Toray Industries, Inc.

4. SBR is a styrene-butadiene copolymer rubber manufactured by Japan Synthetic Rubber Co., Ltd.

What we claim is:

1. A loudspeaker diaphragm made of a mica sheet and consisting essentially of a number of scaly flakes with a size of 8 to 400 mesh of a mica selected from the group consisting of natural mica, synthetic mica and partially dehydrated natural mica and an organic polymeric binder, said scaly mica flakes having their cleavage planes (001 plane) oriented parallel to the surface of the mica sheet and being bonded to one another through said binder at their cleavage planes (001 plane), and said mica sheet having a density of 1.3 to 2.3 g/cm³ and a Young's modulus of $6 \times 10^{10}$ dyne/dm² to $3 \times 10^{12}$ dyne/cm².

2. The loudspeaker diaphragam of claim 1 wherein the content of said binder is 5 to 50% by weight based on the total weight of said mica sheet.

3. The loudspeaker diaphragm according to claim 1, in the shape of a cone.

4. The loudspeaker diaphragm according to claim 1, in the shape of a dome.

* * * * *